US007341373B2

(12) United States Patent
Besse

(10) Patent No.: US 7,341,373 B2
(45) Date of Patent: Mar. 11, 2008

(54) TIMEPIECE WITH JUMPING SECONDS

(75) Inventor: Laurent Besse, Villers-le-Lac (FR)

(73) Assignee: Zenith International S.A., Le Locle (CH)

( * ) Notice: Subject to any disclaimer, the term of this patent is extended or adjusted under 35 U.S.C. 154(b) by 358 days.

(21) Appl. No.: 10/513,560

(22) PCT Filed: Apr. 24, 2003

(86) PCT No.: PCT/CH03/00269

§ 371 (c)(1),
(2), (4) Date: Jun. 27, 2005

(87) PCT Pub. No.: WO03/093908

PCT Pub. Date: Nov. 13, 2003

(65) Prior Publication Data

US 2006/0274608 A1 Dec. 7, 2006

(30) Foreign Application Priority Data

May 2, 2002 (EP) ..... 02405358

(51) Int. Cl.
*G04F 7/04* (2006.01)

(52) U.S. Cl. ..... 368/127

(58) Field of Classification Search ..... 368/127
See application file for complete search history.

(56) References Cited

U.S. PATENT DOCUMENTS 2,921,476 A * 1/1960 Vogt ..... 368/128

* cited by examiner

*Primary Examiner*—Renee Luebke
(74) *Attorney, Agent, or Firm*—Townsend M. Belser, Jr.; Nexsen Pruet, LLC

(57) ABSTRACT

The invention relates to a mechanical timepiece with a jumping second hand (16), consisting of a barrel, a first gear train which is driven by the barrel and which comprises a minute wheel (54) and a second wheel (30), an escapement which is actuated by the gear train and a regulating element, the oscillations of said regulating element being maintained by the escapement. Moreover, the aforementioned escapement comprises an escapement wheel (32) which performs a revolution in 4 seconds by means of jumps. For the purpose of the jumping second function, the inventive piece comprises a second gear train, the first mobile (34) thereof being mounted to the arbor of the escapement wheel (32) and the last mobile (48) of same being mounted to the arbor bearing the hand (16).

20 Claims, 4 Drawing Sheets

TIMEPIECE WITH JUMPING SECONDS

The present invention relates to a mechanical timepiece the movement whereof, whether or not possessing a chronograph mechanism, is provided with a jumping second display device.

In such a device, a second hand makes at high speed, above the dial, one revolution in one, two, three or four seconds, this revolution being divided into several jumps.

According to the construction adopted in the prior art, as described in document EP 0 871 095, the jumping second hand is supported by a mobile whose arbor comprises a pinion and two superposed stars. The pinion is engaged with a gear train culminating in a barrel, preferably a barrel auxiliary to the main barrel of the movement. One of the stars is countersunk on the arbor, while the other is mounted free to rotate and interacts with a control wheel countersunk on the arbor of an escape wheel with pallet undertaking the oscillations of a regulating member, the escapement and the regulating member (spiral balance) being, like the barrel, dedicated to the jumping second function. Typically, the control wheel carries 30 teeth and the free star carries 4 thereof.

Furthermore, the two wheels are coupled together with the aid of a pin integral with the fixed star and passing through a circular oblong opening made in the free star. This pin limits the movement of the free star in order to avoid blocking the control wheel.

Each time the escape wheel stops on the lock of a lift of the pallet, the control wheel immobilizes the free star and releases it on the next oscillation. Thus, for a watch pulsating at 14 400 vibrations, with each oscillation of its balance, the pinion on which the hand and the fixed star are mounted make one rotation of a quarter-revolution. The hand therefore makes one revolution in 4 seconds.

A more precise description of such a particularly ingenious mechanism can be found in the work entitled "Montres compliquées", pages 21 to 26 by François Lecoultre, Editions Horlogères 1951 (Switzerland).

Such embodiments are clearly extremely complicated, costly and bulky since they mobilize in particular one barrel, two stars, one escapement and one regulating member.

The object of the present invention is to provide a system of displaying a jumping second that does not have these disadvantages.

More precisely, the invention relates to a mechanical timepiece with jumping second hand, comprising a barrel, a first gear train driven by the barrel and having a minute wheel and a second wheel, an escapement actuated by the gear train and a regulating member whose oscillations are maintained by said escapement, the latter comprising an escape wheel engaged with the second wheel which makes one revolution per second at most, by means of jumps.

According to the invention, to perform the jumping second function, the piece comprises only a second gear train whose first mobile is mounted on the arbor of the escape wheel and whose last mobile is mounted on the arbor supporting the jumping second hand.

The timepiece according to the invention further exhibits the following main characteristics:

1. the second gear train has the function of transmitting to the jumping second hand the same rotating motion as the escape wheel;
2. the escape wheel makes 1 revolution in 4 seconds;
3. the regulating member oscillates at the frequency of 5 Hz, the jumping second hand thus making 1 revolution in 4 seconds at the rate of 10 jumps per second;

4. the last mobile of the second gear train is concentric with said minute wheel;
5. one of the intermediate mobiles of the second gear train is mounted on a lever that can be actuated manually and is likely to occupy a position for which the intermediate mobile meshes with said last mobile and a position for which the intermediate mobile does not act on the last mobile;
6. a reset heart-piece is mounted on the shaft supporting the jumping second hand;
7. said last mobile is the first of a third gear train driving a timed second hand and a timed hour hand or minute hand.

Other features of the invention will emerge from the following description made with respect to the appended drawing in which.

Figure 1:
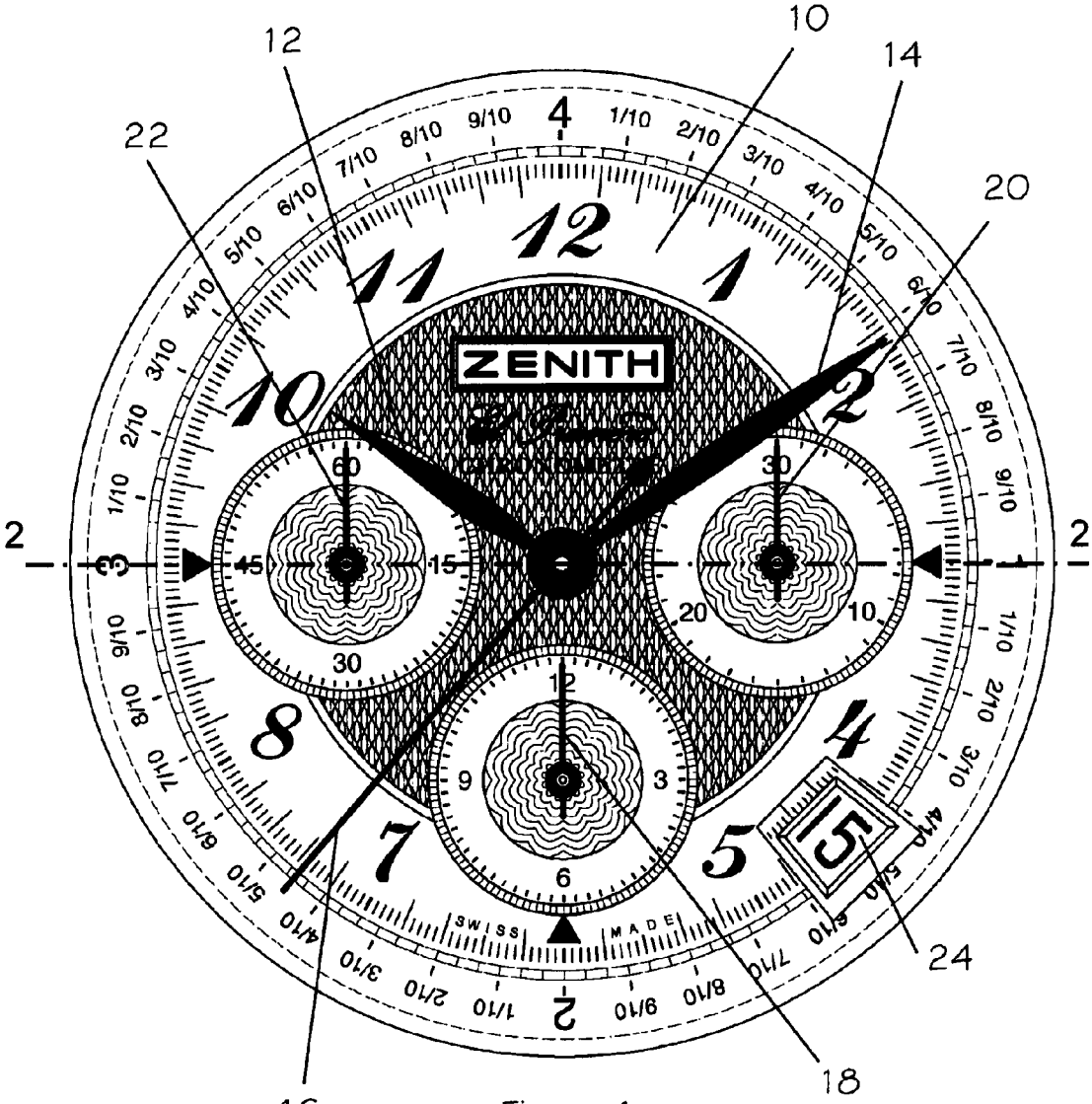
FIG. 1 represents a first execution of the dial of a chronograph watch with jumping second according to the invention.
Figure 2:
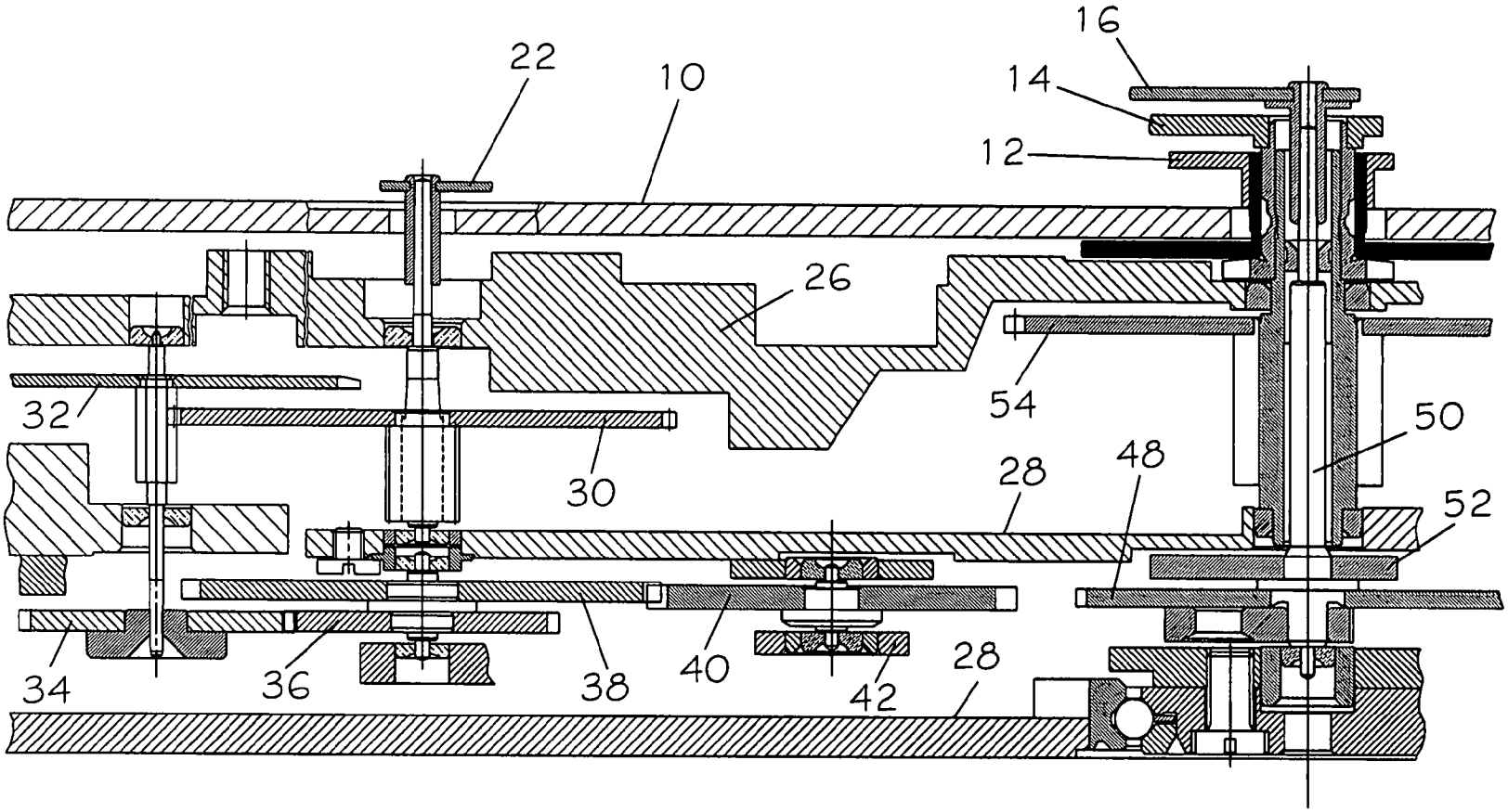
FIG. 2 is a partial view in section along the line 2-2 of the movement of this watch.
Figure 3:
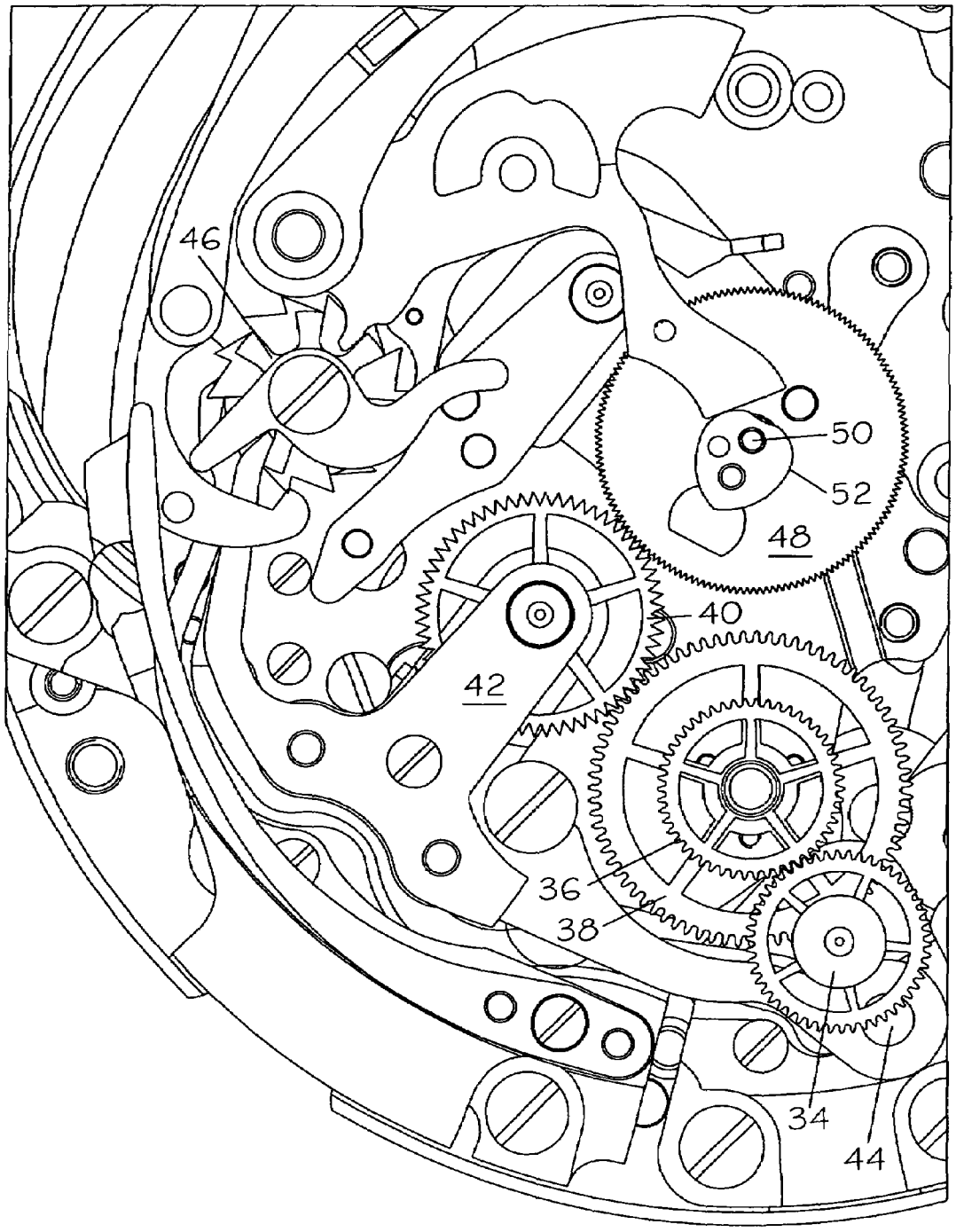
FIG. 3 is a partial representation of this movement seen from the back; finally

The mechanical timepiece represented schematically in FIGS. 1, 2 and 3 is intended to display, on a dial 10, the hour, the minute and the second of the current time, but also the hour, the second and the tenth of a second of the timed time and the day of the month.

As FIG. 1 shows, the hour and the minute of the current time and the tenth of a second of the timed time are displayed in the center of the piece respectively by the big hands 12, 14 and 16. The hour and the second of the timed time, and the second of the current time, are displayed respectively in the 6 o'clock position by a little hand 18, in the 3 o'clock position by a little hand 20 and in the 9 o'clock position by a little hand 22. Finally, the day of the month is displayed by a disk 24 appearing behind an opening made in the dial in the half past 4 position.

The particular feature of this piece resides essentially in the manner in which the hand 16 displays the tenth of a second of the timed time by making one revolution in 4 seconds, at the rate of 10 jumps per second. The other display functions being conventional, they will not be described in detailed manner.

As represented in FIG. 2, the timepiece according to the invention comprises, beneath its dial 10, a movement which includes a frame formed of a plate 26 and bridges 28, serving, in conventional manner, for the positioning of the mobiles.

The shaft to which the current second hand 22 is attached supports a second wheel 30 driven, as is known, at the rate of 1 revolution per minute, by the watch work gear train of the movement. This wheel is engaged with the pinion of the wheel 32 of a pallet escapement (not shown in full) and makes 1 revolution in 4 seconds. The escapement undertakes the oscillations of a regulating member consisting of a spiral balance (not shown) oscillating at 5 Hz or 36 000 alternations, that is 10 alternations per second. Thus, the escape wheel 32 rotates by making 10 jumps per second.

As shown in both FIGS. 2 and 3, the arbor of the escape wheel 32 supports, on the back side, a first wheel 34 meshing with a second wheel 36 identical to the first and mounted on the same arbor of a larger diameter wheel 38. The latter, which thus also makes 1 revolution in 4 seconds, meshes with a clutch wheel 40 mounted on a lever 42, pivoting about a shaft 44 and capable of being actuated by a column wheel 46 controlled by a conventional chronograph mechanism which will therefore not be described in detail.

The column wheel 46 is used to place the lever 42 in two positions. In the position represented in FIG. 3, for which the chronograph function is activated, the clutch wheel 40 meshes with a central chronograph wheel 48 of the same diameter as the wheel 38 and coaxial with the hands 12, 14 and 16. In the other position, not shown, for which the chronograph function is not activated, the clutch wheel 40 does not act on the central wheel 48.

Thus, the wheel 48 also makes 1 revolution in 4 seconds at the rate of 10 jumps per second. This wheel is attached to a shaft 50 supporting the hand 16 which is therefore used to display the tenth of a second on the dial 10.

As is the case with any chronograph, the shaft 50 supports a heart-piece 52 for zeroing the hand 16. As is also known, this shaft is furthermore at the center of a mechanism for driving the hour hand 12 and minute hand 14 from a minute wheel 54 interacting with the second wheel 30 via a third wheel not shown.

Finally, to complete the chronograph function, the central wheel 48 constitutes, in entirely conventional manner, the first mobile of a gear train providing the drive of the second hand 20 and of the hour hand 18. Naturally, the display of the timed hour, performed by this hand, may be replaced by a display of the timed minute.

Figure 4:
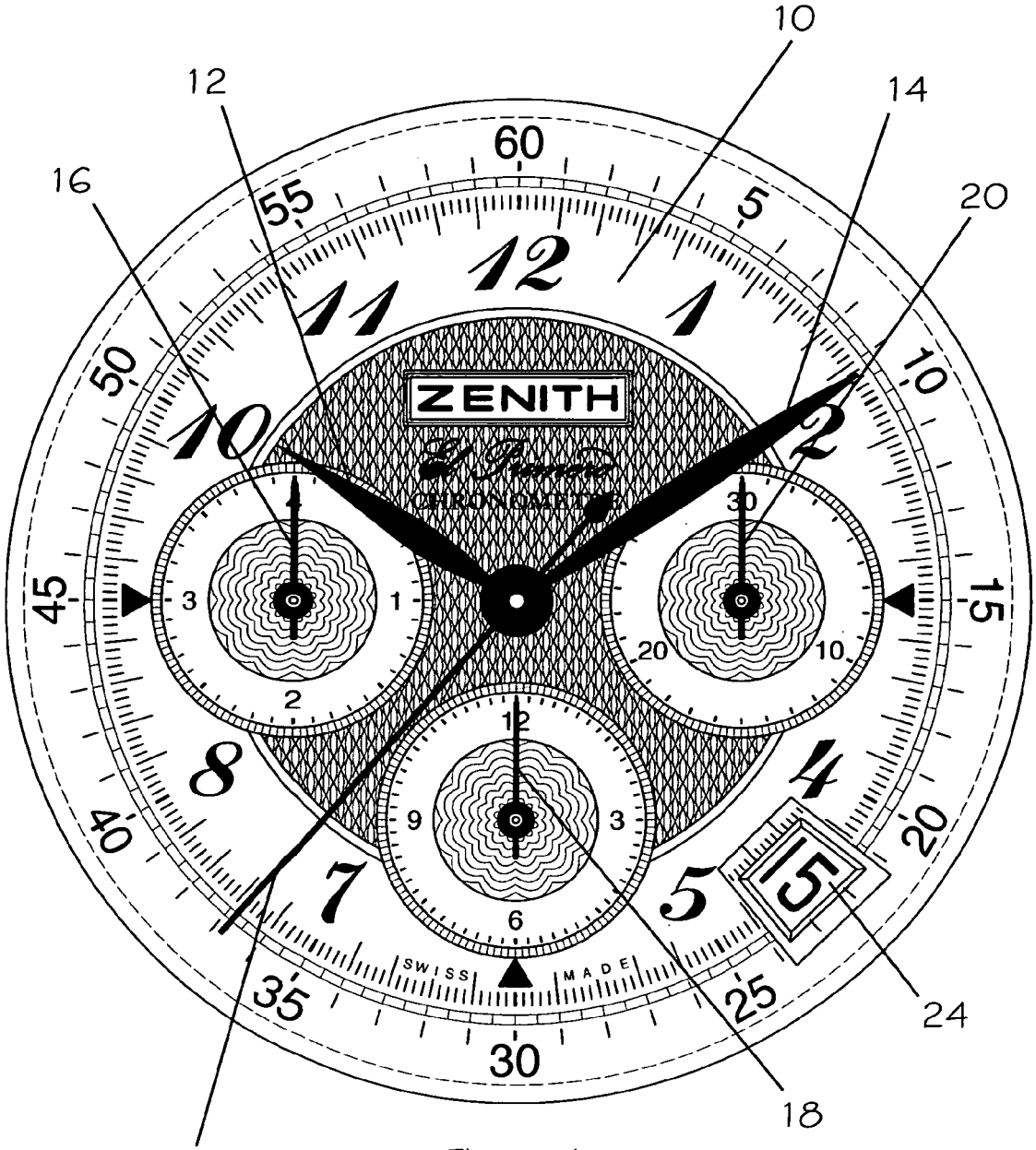
FIG. 4 represents a second possible execution of the dial of the chronograph piece.

The present description has been made essentially with reference to a piece furnished with a jumping second hand at 9 o'clock and a big current second hand. It goes without saying that other embodiments are possible without departing from the scope of the invention. This is how, for example, as shown in FIG. 4, the jumping second hand 16 may be placed at 9 o'clock and replaced, in the center, by the current second hand 22.

This is the proposal for a timepiece that displays the jumping second without using, in particular, a barrel, two stars, an escapement and a regulating member specially assigned to this function.

The invention claimed is:

1. A mechanical timepiece with a jumping second hand, comprising a barrel, a first gear train driven by the barrel and comprising a minute wheel and a second wheel, an escapement actuated by the gear train and a regulating member whose oscillations are maintained by said escapement, the latter comprising an escape wheel engaged with the second wheel which makes one revolution per second at most by means of jumps, and a second gear train comprising a first wheel mounted on an arbor of the escape wheel and a last wheel mounted on an arbor supporting the jumping second hand.

2. The timepiece as claimed in claim 1, wherein the escape wheel is intended to be driven by a rotating motion, and wherein the second gear train has a function of transmitting to the jumping second hand the same rotating motion as the escape wheel.

3. The timepiece as claimed in claim 2, wherein the last wheel of the second gear train is concentric with said minute wheel.

4. A chronograph function timepiece as claimed in claim 3, wherein said second pear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

5. A chronograph function timepiece as claimed in claim 2, wherein said second gear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

6. The timepiece as claimed in claim 5, wherein a reset heart-piece is mounted on a shaft supporting the jumping second hand.

7. The timepiece as claimed in claim 5, wherein said last wheel is the first wheel of a third gear train driving a timed second hand and a timed hour hand or minute hand.

8. The timepiece as claimed in claim 1, wherein the escape wheel makes one revolution in four seconds.

9. A chronograph function timepiece as claimed in claim 8, wherein said second gear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

10. The timepiece as claimed in claim 8, wherein the last wheel of the second gear train is concentric with said minute wheel.

11. A chronograph function timepiece as claimed in claim 10, wherein said second gear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

12. The timepiece as claimed in claim 1, wherein the regulating member oscillates at the frequency of five Hz, the jumping second hand thus making one revolution in four seconds at the rate of ten jumps per second.

13. A chronograph function timepiece as claimed in claim 12, wherein said second gear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

14. The timepiece as claimed in claim 12, wherein the last wheel of the second gear train is concentric with said minute wheel.

15. A chronograph function timepiece as claimed in claim 14, wherein said second pear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

16. The timepiece as claimed in claim 1, wherein the last wheel of the second gear train is concentric with said minute wheel.

17. A chronograph function timepiece as claimed in claim 16, wherein said second pear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

18. A chronograph function timepiece as claimed in claim 1, wherein said second gear train comprises intermediate wheels located between said first wheel and said last wheel, wherein one of the intermediate wheels of the second gear train is mounted on a lever movable manually and intended to be moved between a position for which said intermediate wheel meshes with said last wheel and a position for which the intermediate wheel does not act on the last wheel.

19. The timepiece as claimed in claim 18, wherein a reset heart-piece is mounted on a shaft (50) supporting the jumping second hand.

20. The timepiece as claimed in claim 18, wherein said last wheel is the first wheel of a third gear train driving a timed second hand and a timed hour hand or minute hand.

* * * * *